US008430731B2

(12) United States Patent
Bamberger

(10) Patent No.: US 8,430,731 B2
(45) Date of Patent: Apr. 30, 2013

(54) AIR FLAP FOR CONTROLLING FLOW WITHIN A CONDUIT

(75) Inventor: Georg Bamberger, Winterthur (CH)

(73) Assignee: Belimo Holding AG, Hinwil (CH)

( * ) Notice: Subject to any disclaimer, the term of this patent is extended or adjusted under 35 U.S.C. 154(b) by 1064 days.

(21) Appl. No.: 12/377,724

(22) PCT Filed: Aug. 14, 2007

(86) PCT No.: PCT/CH2007/000398

§ 371 (c)(1),
(2), (4) Date: Mar. 17, 2009

(87) PCT Pub. No.: WO2008/019519

PCT Pub. Date: Feb. 21, 2008

(65) Prior Publication Data

US 2010/0105312 A1 Apr. 29, 2010

(30) Foreign Application Priority Data

Aug. 18, 2006 (CH) ..... 1321/06

(51) Int. Cl.
*F24F 13/14* (2006.01)

(52) U.S. Cl.
USPC ..... 454/266; 454/333; 137/315.16

(58) Field of Classification Search ..... 137/315.16, 137/315.35, 315.38, 454.2, 454.6, 527; 251/298; 454/266, 333, 358
See application file for complete search history.

(56) References Cited

U.S. PATENT DOCUMENTS

| | | | | |
|---|---|---|---|---|
| 1,710,585 | A * | 4/1929 | Matthiessen et al. | 251/298 |
| 2,733,889 | A | 2/1956 | Mattingly | |
| 3,967,813 | A * | 7/1976 | Frohlich | 251/298 |
| 4,605,198 | A | 8/1986 | Greiner | |
| 5,106,052 | A * | 4/1992 | Datta et al. | 251/56 |
| 5,697,596 | A * | 12/1997 | Kremers et al. | 251/58 |
| 5,785,077 | A | 7/1998 | Rice | |
| 6,105,927 | A | 8/2000 | Zelczer | |
| 6,340,150 | B1 * | 1/2002 | Sato et al. | 251/298 |
| 7,537,062 | B2 * | 5/2009 | Hughes et al. | 166/386 |
| 2002/0179159 | A1 | 12/2002 | Zelczer | |

FOREIGN PATENT DOCUMENTS

| | | | |
|---|---|---|---|
| DE | 2232482 | A1 | 1/1973 |
| EP | 501073 | A2 | 9/1992 |
| EP | 598942 | A1 | 6/1994 |
| WO | 2005053975 | A1 | 6/2005 |

* cited by examiner

*Primary Examiner* — John K Fristoe, Jr.
*Assistant Examiner* — R. K. Arundale
(74) *Attorney, Agent, or Firm* — Thaddius J. Carvis

(57) ABSTRACT

A device for controlling an airflow in a ventilation duct, comprising a pivotable air flap, which prevents an airflow in the duct when in the closed position. A housing of an actuator for the air flap, which may pivot freely about the relevant longitudinal mid plane, is mounted in the inner duct wall. The air flap, symmetrically or approximately symmetrically curved about the longitudinal mid plane of the ventilation duct and supported under load in a stable position on the duct wall, is rigidly fixed to the driveshaft of the actuator, by an angled lever arm, with a separation, in the region of the apex line thereof. The air flap rests roughly centrally, permanently on the points of contact with the inner duct wall, which move with the position of the flap, in a self-centering manner and, in the closed position, contacts the inner duct wall along a sealed, endless peripheral sealing surface.

19 Claims, 4 Drawing Sheets

AIR FLAP FOR CONTROLLING FLOW WITHIN A CONDUIT

TECHNICAL FIELD

The invention relates to a device for controlling an airflow in a ventilation duct, comprising a pivotable air flap which can assume adjustable opening positions and which prevents the airflow in the ventilation duct when in a closed position, and a drive which is coupled to the air flap for pivoting the air flap, the drive being arranged on the inside of the ventilation duct.

PRIOR ART

The term "ventilation duct having a duct wall of constant cross section" is used in particular for ducts of internally round or elliptical cross section. Ventilation systems are used in buildings, in particular domestic, office, commercial and industrial constructions and also tunnels, generally combined with fire and smoke protection means, but also in the automotive industry. Conversely, a rectangular cross section is not "constant" in the sense of this definition.

In ventilation systems, the volume flow controller with pivotable air flaps is very important. The volume flow is measured using a suitable measuring instrument, for example using a NMV-D2M (Belimo Automation AG, CH-8340 Hinwil, Switzerland) which is embodied as a compact unit consisting of a drive, pressure sensor and controller, which apparatus allows the volume flow to be displayed in $m^3/h$. This greatly simplifies the setting and optimizing of the ventilation system and allows lower operating costs.

The geometric shape of the flat air flaps is adapted to the geometric duct cross section; a round, elliptical or rectangular shape is particularly suitable. In the closed position, the plane of the flap generally runs perpendicularly or at a defined angle of between 50° and 90°. In the case of a round ventilation duct, a round or elliptically embodied flap is therefore obtained as the optimum solution.

U.S. Pat. No. 6,105,127 A describes an air flap having a sandwich structure. Two rigid circular disks having a diameter somewhat smaller than the internal diameter of the ventilation duct fix an internal third disk which is made of a soft material, protrudes in a peripherally annular manner and is bent over in the end position running perpendicularly to the longitudinal axis of the ventilation duct. Thus, a better seal can be generated than with two rigid materials lying one on the other. The pivoting movement is produced by a connecting rod acting on a lever arm.

WO 2005/053975 A1 describes a fundamentally novel device for controlling the airflow in a ventilation duct with one or more air flaps which can be actuated in synchronization and prevent the airflow when in the closed position. A fastening web, with a rotary bearing for the drive axle of the kit and means for transmitting force and/or torque to the drive axle which is connected to the air flap, runs on the inside of a longitudinally running plane of symmetry of the ventilation duct. The same fastening web, which can be fitted with various air flaps, can be used for ventilation ducts of differing cross-sectional design. The basic shape of the air flap is circular or elliptical, the drive axle lies on the small diameter thereof. Preferably, the fastening web runs at an angle of from 15 to 90°, based on the longitudinal axis of the ventilation duct.

ACCOUNT OF THE INVENTION

The present invention is based on the object of providing a device of the type mentioned at the outset, which device further improves the efficiency of the air flap without external drives, lever systems or bearing points leading through the duct wall. Furthermore, it should be possible to integrate or to insert the device more easily into an existing ventilation duct.

According to the invention, the object is achieved in that the air flap has an elastic surface body which is curved and thus under load and contacts, in the open positions, two contact point regions, diametrically opposing each other with respect to an apex line of the surface body, in the ventilation duct.

The air flap or the surface body (for example a plastics material sheet) is therefore clamped in the ventilation duct and rests on two contact points acting as points of rotation of the air flap.

Preferably, the elastic air flap, which is symmetrically or approximately symmetrically curved about the longitudinal mid plane of the ventilation duct and supported under load in a stable position on the duct wall, is rigidly fixed to the drive shaft of the drive motor, by an angled lever arm, with a separation a, in the region of the apex line thereof. The air flap is thus in principle held at three points. The mechanical connection to the drive can also take place differently.

As a result, the air flap rests roughly centrally, permanently on the points of contact with the inner duct wall, which move with the position of the flap, in a self-centering manner and, in the closed position, contacts the inner duct wall along a sealed, endless peripheral sealing surface, the contact points lying on the virtual intersection of the longitudinal axis of the drive shaft with the duct wall. Specific and developing embodiments of the device form the subject-matter of dependent claims.

The drive housing, which contains the drive, is mounted at an inner wall of the ventilation duct such that it may pivot freely about a longitudinal mid plane, which is defined or spanned together with the apex line, of the ventilation duct. The drive motor transmits its torque to the drive shaft with the aid of the step-down gear and to the air flap by the lever arm. During a closing and opening movement of the air flap, the angle of the drive housing relative to the longitudinal mid axis of the ventilation duct necessarily shifts in a self-centering manner. Accordingly, the points of contact of the air flap with the inner duct wall move. The closing movement is completed when the air flap contacts the duct wall in a sealing manner along the entire circumference and forms a sealing surface. The maximum flow is attained when the apex line of the air flap runs parallel to the aforementioned longitudinal mid axis. Between the closed position and the maximum opening position, any position of the air flap can be set for controlling flow.

Preferably, the air flap is curved in a concave manner viewed in the direction of flow, i.e. upstream. As a result, the contact force with the duct wall is increased by the load in a pressure-dependent manner and the sealing effect is increased. In other words, for a working pressure to be set, an air flap having a lower inherent tension can be used; this means a significant saving of materials or possible use of a less expensive material.

According to the invention, the apex line of the air flap does not intersect the pivot axle, which is expediently identical to the drive shaft, but rather runs with a separation therefrom and with leverage. The blank of the relaxed air flap lying on one plane (i.e. the surface body) is therefore not elliptical, but rather has a complex shape which is to be determined mathematically and is embodied so as to be symmetrical with respect to the apex line, but asymmetrical at right angles thereto. The planar air flap having a constant circumference is calculated with respect to a specific optimum closure angle of the curved air flap, which is inserted inside the duct, to the longitudinal mid axis. This angle (measured between the longitudinal mid axis of the ventilation duct and the apex line of the air flap) is preferably less than 90° and lies for example in the range of from 60 to 80°, in particular at approximately 70°.

The intersection existing between the transverse line (R) and the apex line (S) divides the apex line (S) into two different portions. The portions are of differing length, one portion (f) being no more than 4/5 of the length of the other portion (e). This geometry provides an advantageously curved air flap which operates at a closure angle of less than 90°.

The air flap is made of a corrosion-resistant, elastic metal, in particular spring steel, or a mechanically dimensionally stable, resilient plastics material, in particular a polyethylene terephthalate or a polyamide. The thickness of the air flap is calculated in a materially-specific manner in accordance with the required contact pressure of the curved air flap on the duct wall by means of inherent tension, taking into account the pressure exerted thereon by the air pressure. The planar dimensions of the air flap are calculated from the following parameters: internal diameter of the duct wall to be fitted, closure angle of the apex line relative to the longitudinal mid axis of the ventilation duct, radius of curvature of the inserted air flap and separation of the apex line of the air flap from the drive shaft forming the pivot axle, wherein

- when the air flap is closed, the constant circumference thereof forms a peripheral sealing surface on the inner duct wall, and
- in each partial or complete opening position, the two points of contact with the inner duct wall lie in virtual intersection with the extended pivot axle.

According to a preferred embodiment of the invention, an annularly protruding or U-shaped elastic seal, made expediently of rubber, an elastomer or a soft plastics material, is arranged over the entire constant circumference of the air flap.

The sealing lip can be formed integrally in one piece with the surface body forming the air flap. Advantageously, the sealing lip is smaller at the contact point regions than in a region of the apex line. This allows the resistance during rotation of the air flap to be reduced compared to an embodiment with a sealing lip of constant width.

In particular, the surface body is composed of a disk which is made of the highly elastic material and is arranged as a peripherally protruding core layer between two metallic, thermosetting or thermoplastic cover disks. This therefore forms an air flap which is made of a flexible composite material and compensates for and seals any untight points resulting from out-of-roundness of the duct along the circumference of the air flap.

According to a particularly advantageous variant of the invention, the two cover disks are arranged in a non-congruent manner. One of the cover disks runs alternately with a smaller radius over one half-circumference, lying between the contact points, i.e. is arranged so as to be set back. The endless peripheral, annular seal therefore does not run, as is conventional, with two cover disks of equal size. The arrangements with a sealing lip protruding uniformly over the entire circumference have the drawback that the sealing material becomes markedly deformed and stuck in the closed position of the air flap; this can necessitate a much greater torque during opening. The alternately set-back cover disks prevent the sealing material from becoming stuck. During opening of the air flap, the larger cover disk can press the sealing material away unimpeded, i.e. much less torque is required.

According to a further embodiment of the invention, the region of the apex line of the air flap is reinforced by longitudinally running webs or ribs which can extend up to the circumference. This does not restrict or restricts only slightly the curvature formed in the ventilation duct, but reinforces the air flap in the direction of the apex line. These longitudinally running ribs are attached to the air flap, for example by welding, soldering or bonding, or formed in one piece therewith.

In relation to the method for inserting or exchanging the device, the object is achieved according to the invention in that an opening, in particular a rectangle which is elongated in the axial direction of the ventilation duct, is cut out of the ventilation duct, the device is fastened to a blank of duct material or transparent material protruding beyond the opening on all sides, introduced with the elastic air flap bent markedly over, and the opening sealed again.

Preferably, the blank is made of transparent material, allowing the inserted device with the air flap to be viewed.

In summary, the invention has the following advantages:

- The air flap is embodied in such a way that it is supported roughly centrally and in a self-centering manner at the duct wall without rotary bearings passing through the wall. This produces a three-point support defining a plane; this contributes to stability.
- As a result of the concave curvature in the flow direction, as the pressure in the ventilation duct increases, the air flap is pressed more intensively against the duct wall; this improves the seal.
- The air flap is very simple to mount; the blank can be guided bent through a comparatively narrow opening; when detached, the air flap rests momentarily against the inner wall. The air flap can be fitted in any desired position. The mounting opening extends over less than half the duct; this makes a significant contribution to obtaining stability of the ventilation duct.
- All that is used is a suspension which guides the power and signal conductors for the internal drive through the duct wall.

BRIEF DESCRIPTION OF THE DRAWINGS

Figure 4:
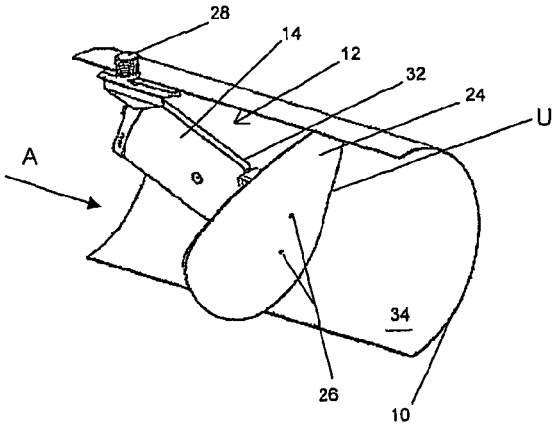
FIG. 4 shows schematically the device according to FIG. 3 with a closed air flap.

The invention will be described hereinafter in greater detail with reference to exemplary embodiments which also form part of the subject-matter of dependent claims and are illustrated in the drawings, in which:

FIGS. 1 to 4 show a device 12 which is inserted in a ventilation duct 10 for controlling an airflow A. The device 12 comprises substantially a freely pivotable drive housing 32 with a drive motor 14 and a step-down gear 16 exerting a torque onto a drive shaft 18. This drive shaft 18 is rigidly connected to a lever arm 20 which juts out at right angles and is in turn folded at right angles in the direction of the drive housing and thus forms a contact surface 22 for an elastic air flap 24 fixed thereon. If the lever arm 20 is, in accordance with a variant (not shown), embodied in a U-shaped manner and connected to the drive shaft 18 via two legs, the base forms the contact plate 22 for the air flap 24. Said air flap is, as shown in FIG. 4, fixed using two screws 26 to the contact plate 22 which has a separation a from the longitudinal axis of the drive shaft 18.

The device 12 or the drive housing 32 is suspended from a pivot bearing 30 which, for its part, is fastened to or, as in a variant (not shown), snapped onto a hollow screw 28 passing through the ventilation duct 10. The positional angle $\alpha$ of the drive housing 32, which may pivot freely about a longitudinal mid plane $L_M$, relative to the longitudinal mid axis $L_A$ of the ventilation duct 10 is dependent on the pivot angle of the curved air flap 24. Electric conductors for transmitting power and signals are fed into the inside of the duct via the hollow screw 28.

The elastic air flap 24, which is introduced into the ventilation duct 10, contacts—apart from the closed position—the inner duct wall 34 in a curved manner at two diagonally opposing contact points 36, 38. The air flap 24 is designed in such a way that the contact points 36, 38 form at the same time the virtual piercing points of the longitudinal axis $L_W$ of the drive shaft 18 with the duct wall 34. Obviously, these contact points 36, 38 are not to be interpreted in the purely geometric sense; they are formed as a contact surface of minimum extension. It is essential to the invention that the duct wall 34 is not pierced at these contact points 36, 38, but that these contact points 36, 38 move as a function of the pivot angle of the flap 34 with the varying angle $\alpha$ of the motor housing 32. In the closed position according to FIG. 4, the contact points 36, 38 may no longer be seen. The air flap 24 now contacts along its entire, continuous circumference U, not the contact points 36, 38, but rather the duct wall 34 and thus completely seals the ventilation duct 10.

Figure 1:
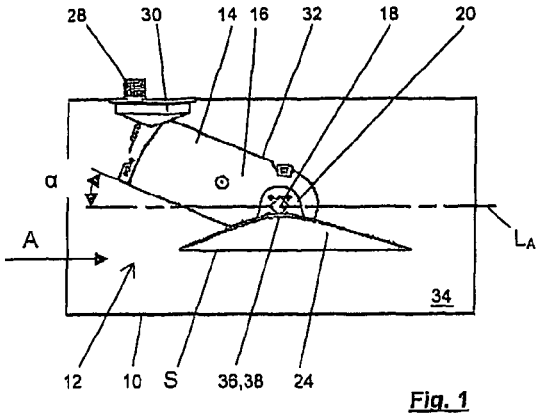
FIG. 1 is a schematic view of a device with an air flap which has been opened as far as possible and is inserted in a ventilation duct shown in a cut-open view.
Figure 2:
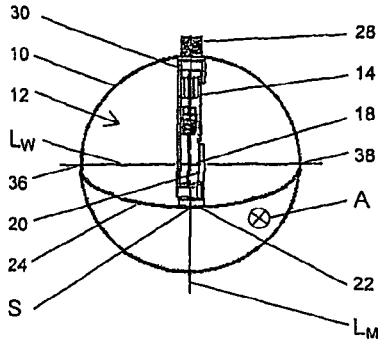
FIG. 2 is a schematic side view of FIG. 1 in the direction of the airflow.

The curvature of the air flap 24 and the symmetry thereof with respect to the longitudinal mid plane $L_M$ may be seen particularly clearly from FIG. 2. FIG. 4 reveals that the air flap contacts, in the closed position, so as to be curved in a concave manner in the direction of the airflow A, i.e. upstream. In other words, the concave curvature is formed on the side of the lever arm 20 holding the surface body. This takes place on the one hand as a result of the spring-back force of the air flap 24 and on the other hand as a result of the pressure of the airflow A.

The apex line S of the symmetrically curved air flap 24 runs, irrespective of the pivoting position thereof, in all cases on the longitudinal mid plane $L_M$ of the ventilation duct 10.

Figure 3:
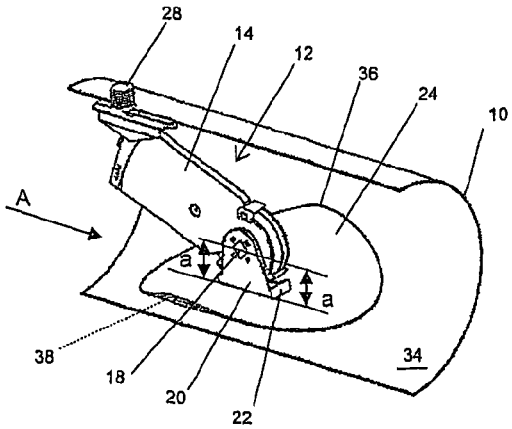
FIG. 3 is a schematic perspective view of the device according to FIG. 1 with an open air flap.
Figure 5:
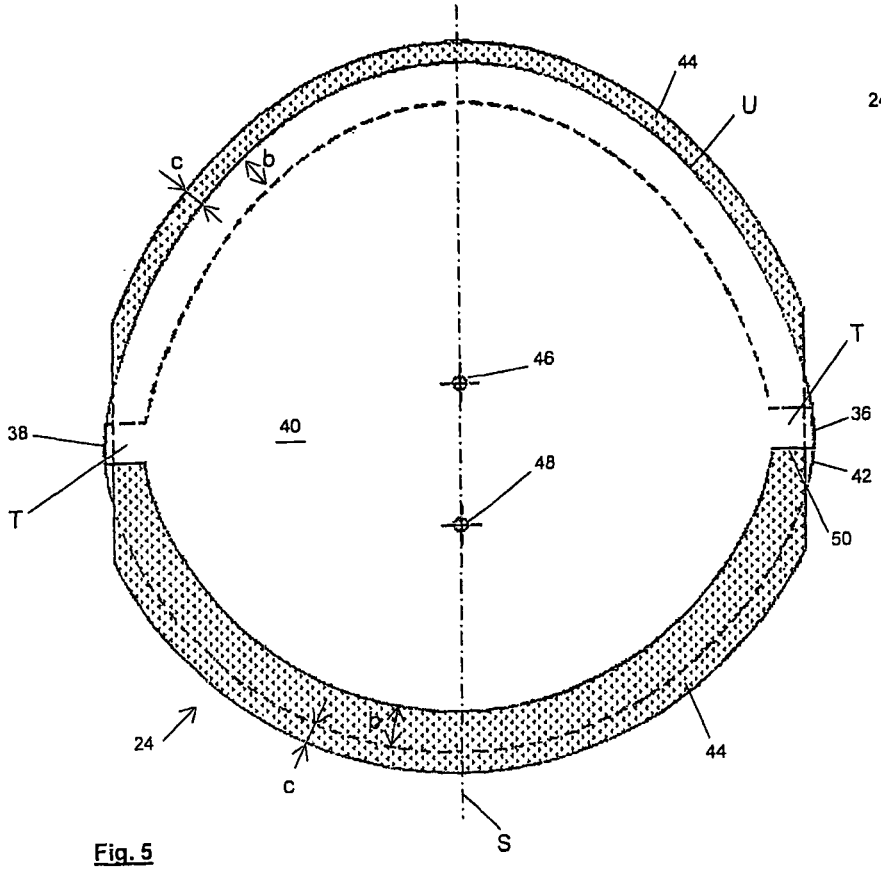
FIG. 5 is a schematic plan view onto an air flap which is designed in a planar manner and made of composite material.
Figure 6:
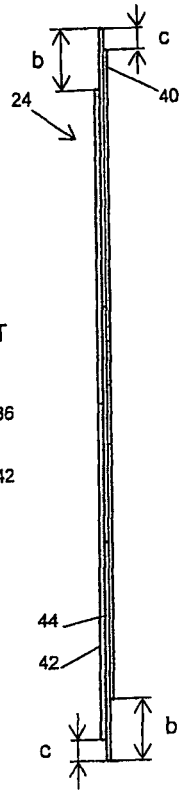
FIG. 6 is a schematic side view of FIG. 5.
Figure 7:
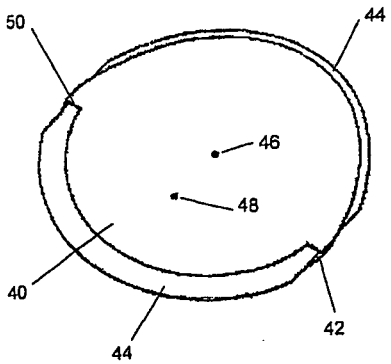
FIG. 7 is a schematic perspective view of FIG. 5.

FIGS. 5 to 7 show a relaxed elastic air flap 24 which is embodied as a layered composite and lies on one plane. Arranged between the two cover disks 40, 42, which are made of approximately 0.2 mm-thick spring steel, is a core layer 44 which is made of an approximately 0.5 mm-thick elastomer layer which protrudes peripherally. The upper cover disk 40, as seen in the viewing direction of FIG. 5, covers the elastic air flap 24 almost completely. The elastic air flap 24 is symmetrical with respect to the virtual apex line S formed during bending. The apex line runs between two drill holes 46, 48 via which the air flap 24 is fixed to the contact plate 22 (FIG. 3).

In contrast to an ellipse, the substantially egg-shaped air flap 24 has no plane of symmetry running perpendicularly to the apex line S. However, the two cover disks 40, 42 overlap in the peripheral region only in the two tangential regions T. Here, the core layer 44 is cut back parallel to the apex line S in such a way that the two cover disks 40, 42 remain, without a core layer lying therebetween, in the aforementioned tangential regions T. As a result of this measure, the air flap 24, which is inserted in a ventilation duct 10, is displaceable and pivotable with less resistance on the contact points 36, 38.

FIGS. 5 and 7 show the lower cover disk 42 only as a small spike. The continuous circumference U formed by the two cover disks 40, 42 is formed also in the overlapping tangential region T.

Viewed from above (FIG. 5) or from the right (FIG. 6), the elastomeric core layer 44 protrudes in the upper part peripherally by c, in the lower part by b+c. Viewed from below (FIG. 5) or (FIG. 6), the elastomeric core layer 44 protrudes in the upper region by b+c, in the lower region merely by c.

Figure 8:
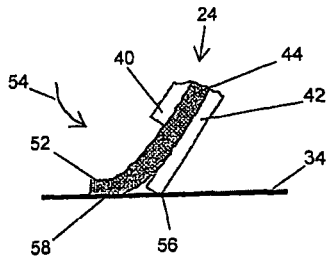
FIG. 8 is a schematic section through a peripheral region of a closed air flap.

FIG. 8 shows the peripheral region of a sealed air flap outside the tangential regions T (FIG. 5), in particular in the region of the apex line (S), with a protruding core layer 44 which is made of an elastomer and embodied as a sealing lip 52. The air flap 24, which is arranged in a curved manner in a ventilation duct 10 having a duct wall 34, is rotated in the direction of the arrow 54 until it strikes with its peripheral edge 56 the inner duct wall 34 and forms a first sealing lip. In the end phase of this pivoting movement, the sealing lip 52 is bent over and forms on the inner duct wall 34 a second sealing surface 58. The free space created by the setting-back of the upper cover disk 40 relative to the lower cover disk 42 prevents the highly elastic material of the core layer from undergoing excessive deformation and from leading to jamming during the opening of the air flap 24 in the opposite direction to the arrow 54. On the diagonally opposing side of the air flap 24, the same takes place in a mirror-symmetrical manner with respect to the mid plane between the cover layers 40, 42. An arrangement according to FIG. 8 is also referred to as a double lip.

Figure 9:
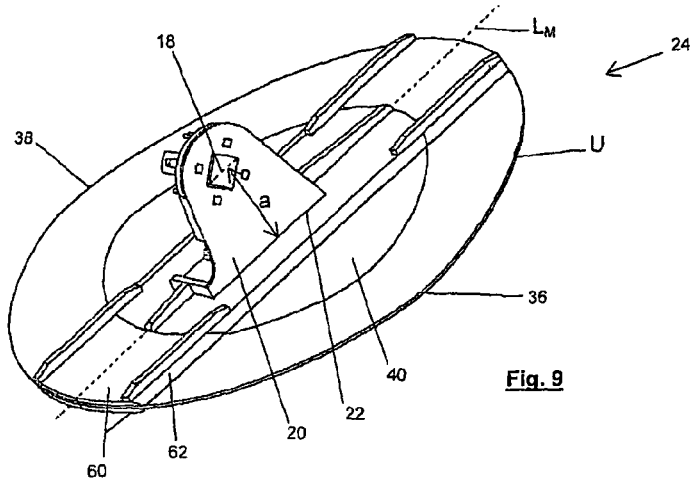
FIG. 9 is a schematic perspective view of a reinforced air flap.

The elastic air flap 24 according to FIG. 9 has in the region of the longitudinal mid axis L two reinforcement plates 60 which secure the elastic air flap lying therebetween. Also arranged are longitudinally running reinforcement ribs 62 which, like the angled lever arm 20, are bonded, soldered or welded onto the contact plate 22. If the upper cover disk 40 is made of plastics material, the reinforcement elements 60, 62 and the lever arm 20 can also be made in one piece. Finally, the separation a of the pivot axle of the drive shaft 18 from the contact plate 22 is indicated for the elastic air flap. This separation a is, as mentioned hereinbefore, a determining variable for calculating the surface shape of the air flap 24; the larger the separation a is, the more said air flap differs from the elliptical shape.

The sequence illustrated in FIGS. 10-15 shows the integration of a device according to the invention into a ventilation duct at any desired point.

Figure 10:
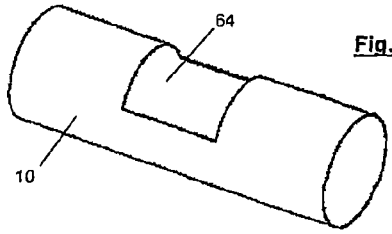
FIGS. 10-15 are schematic perspective views of the integration of a device according to FIGS. 1-4 into a ventilation duct.

FIG. 10. An opening 64, which is rectangular in its projection, is cut out of a ventilation duct 10. For reasons of clarity, the illustrated opening 64 extends over a larger portion of the circumference than is necessary in practice. Under no circumstances may the opening be larger than half the circumference; the opening 64 is as small as possible so as not to restrict the stability of the ventilation duct 10.

Figure 11:
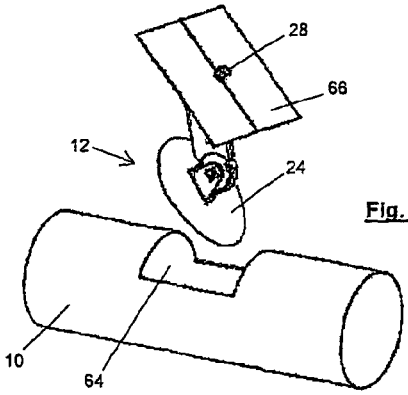

FIG. 11. Above the ventilation duct 10 with the opening 64, a device 12 for controlling the airflow is fastened by a hollow screw 28 to a blank 66 made of duct material. The elastic air flap 24 is relaxed and lies on one plane.

Figure 12:
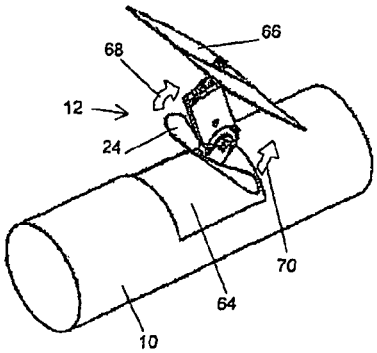

FIG. 12. The air flap 24, which has been raised on both sides in the direction of the arrows 68, 70 to form a curvature, has already been partly introduced into the opening 64.

Figure 13:
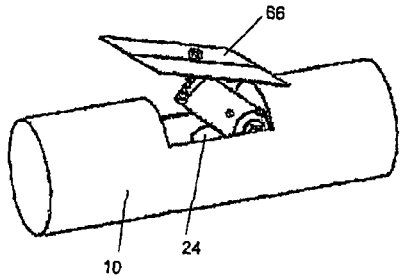

FIG. 13. The air flap 24, which has already been completely introduced into the ventilation duct 10, has partly relaxed; it contacts the inner duct wall 34 under its inherent tension.

Figure 14:
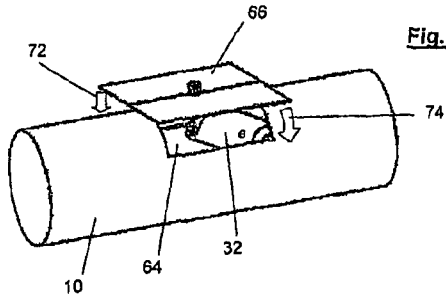

FIG. 14. The device 12, with the freely pivotable drive housing 32 and the air flap (which may no longer be seen), is inserted completely into the ventilation duct 10. The blank 66 contacts as the tangential plane overlapping the opening 64 on all sides. The next step, the bending-over of the blank 66 onto the ventilation duct 10, is indicated by arrows 72, 74.

Figure 15:
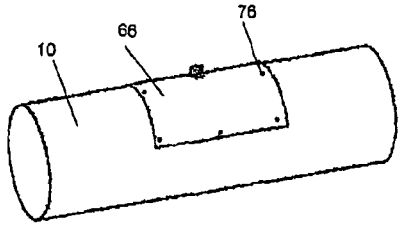

FIG. 15. The blank 66 contacts the ventilation duct 10 so as to seal the opening 64 on all sides and is detachably or non-detachably connected to said ventilation duct, in this case by means of screws 76.

According to a variant, the blank 66 is also made of a material other than duct material, in particular of a flexible transparent material. In this case, the device 12 with the elastic air flap 24 can be observed and monitored from the outside.

Figure 16:
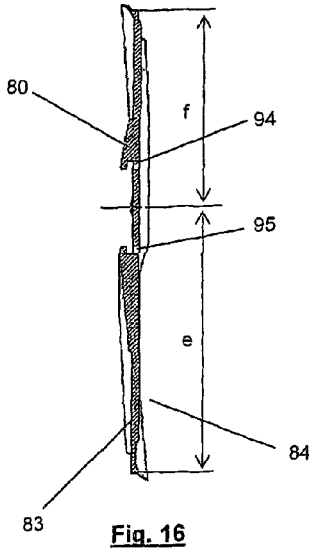
FIGS. 16-18 are schematic sectional views of the surface body of the air flap and a schematic plan view thereon.
Figure 17:
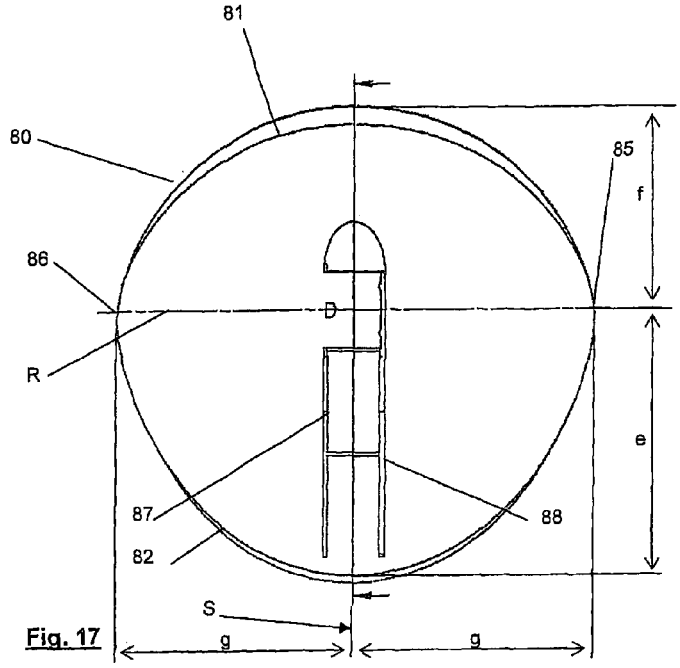
Figure 18:
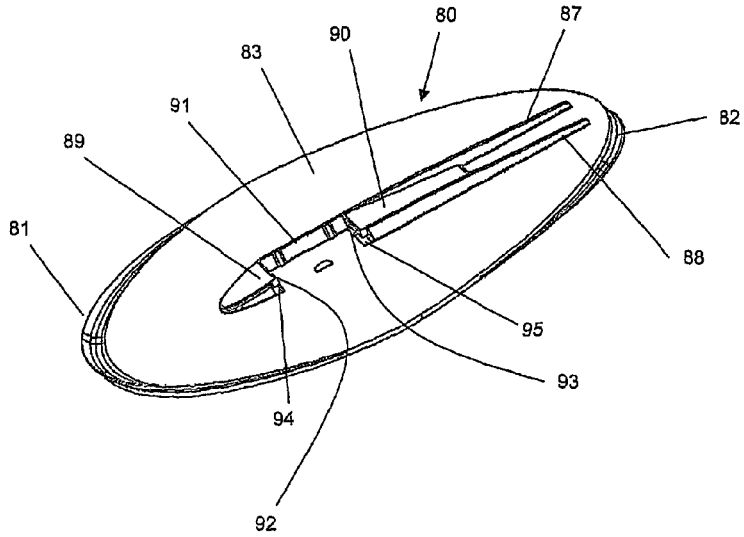

FIGS. 16 to 18 show a further preferred embodiment of the invention. The air flap is formed substantially by a flexible, one-piece plastics material disk 80. The plastics material disk 80 is oval and can be characterized by the apex line S and the transverse line R standing perpendicularly thereto. The apex line S is determined by the longest diameter line of the plastics material disk 80. The transverse line R is determined by the diameter line of greatest length standing perpendicularly thereto. At the point of intersection of the apex line S and transverse line R, the transverse line R is halved. In FIG. 17, the half-transverse line R is denoted by g. On the other hand, the apex line S is divided by the transverse line R into two portions e and f of unequal size.

Preferably, the following applies:

$$f \approx \frac{4}{5}e$$

Thus, in the closed position of the air flap, an angle of from 60-80° can be attained. For an angle of approximately 70° and a duct diameter of from 125-150 mm, a ratio of $$f \approx \frac{3}{4}e$$

has proven to be particularly good. The apex line S is slightly larger than the transverse line R. In the case of a closure angle of for example 70°, values in the range $$0.96<(e+f)/2g\leqq 0.99$$

have proven to be particularly preferable. The values are therefore <1 and >0.95. It should be noted in this case that for a closure angle of less than 90°, both the apex line S=(e+f) and the transverse line R=2g are somewhat larger than the internal diameter of the ventilation duct into which the air flap is inserted.

In the embodiment according to FIGS. 16-18, two sealing lips 81, 82 are formed integrally with the plastics material disk 80. The width of the sealing lip 81, 82 varies continuously along the circumference of the plastics material disk 80. In the edge regions 85, 86, in which the transverse line R abuts against the circumference, there are no sealing lips. At the location where the apex line S abuts against the circumference of the plastics material sealing disk 80, they are maximum width and stand there for example at an angle of 45° to the plane of the plastics material disk 80. As may be seen from FIGS. 16 and 18, the sealing lips 81 and 82 are thinner than the plastics material disk 80 and attach to opposing main surfaces 83 and 84 respectively. When the air flap is fitted, the contact or three-point regions according to the invention of the air flap are located in the edge regions 85, 86.

Reinforcement ribs 87, 88 are provided parallel to the apex line S, but slightly laterally offset therefrom, on one main surface 83. In the case of the embodiment shown, said reinforcement ribs extend roughly over half the length of the apex line S, in the region of the portion of the apex line that is denoted by a (see FIG. 17).

A first fastening element 90 is provided between the reinforcement ribs 87, 88. A second fastening element 89 is provided mirror-symmetrically with respect to the transverse line R. The two fastening element 89, 90 rise up out of the main surface 83 and are in particular plate or ramp-shaped and, viewed from above, strip-shaped. In addition, they can also serve as a reinforcement of the plastics material disk 80 along the apex line S. At the mutually facing sides, the fastening elements 89, 90 have snap lock devices 92, 93 for an actuating lever of an air flap drive. Furthermore, a flank 91, which laterally delimits the free region formed between the fastening elements 89, 90, protrudes from the main surface 83. In the present example, the flank 91 is an extension of the rib 87 and has preferably also locking elements for fixing the fastening lever (not shown).

In the embodiment according to FIGS. 16 to 18, a pierced opening 94, 95 (which is induced by manufacture) is associated with each of the two snap lock devices 92, 93. Said pierced openings are covered by the coupling element formed on the actuating lever (which coupling element interacts with the snap lock devices 92, 93). In the assembled state, the plastics material disk 80 is thus airtight.

The described exemplary embodiments can be modified in a large number of respects. The reinforcement along the apex line can be integrated in the plastics material disk 80 (for example in the form of integrated material reinforcements). The fastening of the plastics material disk can also take place by screwing or adhering, instead of by snapping. The sealing lips 81, 82 can be made of the same material as the plastics material disk 80 or of a different material. Nor is it compulsory for their width to vary continuously along the circumference.

The described exemplary embodiments are designed for a closure of approximately 70°. In the case of other closure angles, the lengths of the apex line and transverse line are different. However, they will vary by no more than 10% for variant embodiments having a closure angle in the range of from 60°-80° or even of up to about 90°.

In summary, it should be noted that the invention has provided an air flap which has a simple design and can be installed very easily and rapidly.

The invention claimed is:

1. A device for controlling an airflow in a ventilation duct, comprising:

a) a pivotable air flap which can assume adjustable opening positions and which prevents the airflow in the ventilation duct when in a closed position, b) a drive which is coupled to the air flap for pivoting the air flap, the drive being arranged on the inside of the ventilation duct, characterized in that c) a drive housing, which contains the drive, being suspended from a pivot bearing fastened to an inner wall of said ventilation duct, said drive housing being freely pivotable about a longitudinal mid plane of the ventilation duct, which is defined together with an apex line, in dependence of the pivot angle of the air flap in said ventilation duct, d) wherein the air flap has a curved elastic surface body which is supported under load in a stable position within the ventilation duct and contacts the ventilation duct in the open positions in two contact point regions, said contact point regions being arranged diametrically opposing each other with respect to an apex line of the surface body, and e) wherein the air flap rotates about the two contact point regions when rotated between the opening positions while the contact points act as points of rotation of the air flap.

2. The device as claimed in claim 1, characterized in that the surface body has an oval surface contour having a maximum extension along the apex line and a minimum extension along a transverse line perpendicular to the apex line.

3. The device as claimed in claim 2, characterized in that an intersection of the transverse line with the apex line divides the apex line into two portions of differing length, one portion being no more than ⅘ of the length of the other portion.

4. The device as claimed in claim 1, characterized in that in the closed position the apex line is at a closure angle $\alpha$ of less than 90° relative to a longitudinal mid axis of the ventilation duct.

5. The device as claimed in claim 4, characterized in that in the closed position the apex line is at a closure angle of from 60° to 80°.

6. The device as claimed in claim 1, characterized in that the surface body is embodied so as to be minor-symmetrical with respect to the apex line and asymmetrical perpendicularly thereto.

7. The device as claimed in claim 1, characterized in that the air flap is symmetrically or approximately symmetrically curved about the apex line and is rigidly fixed to a drive shaft of the drive, by an angled lever arm with a predefined separation, in the region of the apex line lying in the longitudinal mid plane, which is defined together with the apex line, of the ventilation duct.

8. The device as claimed in claim 1, characterized in that the surface body contacts, in the closed position, an inner duct wall of the ventilation duct along a sealed, endless peripheral sealing surface.

9. The device as claimed in claim 8, characterized in that a surface body has at the edge side a sealing lip which is smaller at the contact point regions than in a region of the apex line.

10. The device as claimed in claim 1, characterized in that the contact point regions lie on virtual intersections of a longitudinal axis of the drive shaft with the duct wall.

11. An air flap for a device as claimed in claim 1, wherein a) the air flap has an elastic surface body which can be curved under load for insertion into a ventilation duct and which has a shape which is mirror-symmetrical with respect to an apex line and asymmetrical perpendicularly thereto and b) has wherein the air flap comprises two contact point regions, which diametrically oppose each other with respect to an apex line of the surface body and are embodied for mounting in a ventilation duct, the contact point regions being free from a sealing lip.

12. A device for controlling an airflow in a ventilation duct, with at least one pivotable air flap which prevents the airflow in the ventilation duct when in a closed position, wherein a drive housing for the air flap, which drive housing may pivot freely about a longitudinal mid plane of the ventilation duct pipe, is mounted at an inner wall of the ventilation duct, characterized in that the elastic air flap, which is symmetrically or approximately symmetrically curved about the longitudinal mid plane of the ventilation duct and supported under load in a stable position on the inner wall of the ventilation duct, is rigidly fixed to a drive shaft of a drive motor, by an angled lever arm, with a separation, in the region of an apex line thereof, said drive motor being contained in a drive housing being suspended from a pivot bearing fastened to the inner wall of said ventilation duct, and said elastic air flap resting roughly centrally, permanently on point of contact regions with the inner wall of the ventilation duct, which move with the position of the flap, in a self-centering manner and, in the closed position, contacts the inner wall of the ventilation duct along a sealed, endless peripheral sealing surface, the point of contact regions with the inner wall of the ventilation duct lying on a virtual intersection of the longitudinal axis of the drive shaft with the duct wall.

13. The device as claimed in claim 12, characterized in that the air flap or the surface body is curved in a concave manner in the flow direction and in that the air flap is made of a corrosion-resistant, elastic metal, or a mechanically dimensionally stable, resilient plastics material.

14. The device as claimed in claim 13, characterized in that an annularly protruding, highly elastic seal, is made of a rubber, an elastomer or a soft plastics material, and is arranged over the entire circumference of the air flap.

15. The device as claimed in claim 12, characterized in that the air flap is made of a peripherally protruding core layer made of a rubber, an elastomer or a soft plastics material, and two metallic or thermoplastic cover disks.

16. The device as claimed in claim 15, characterized in that the cover disks are arranged in a non-congruent manner, such that along a half-circumference of the periphery of the air flap lying between the contact point regions, one cover disk is set back relative to the second cover disk.

17. The device as claimed in claim 11, characterized in that the region of the apex line is embodied so as to be reinforced, by longitudinally running reinforcement plates and reinforcement ribs which also extend up to the circumference.

18. The device as claimed in claim 17, characterized in that the lever arm, the reinforcement plates and the reinforcement ribs and also the air flap are formed in one piece.

19. A method for inserting or exchanging the device as claimed in one of claims 1-4, 6-13, 14 to 18 and 5, characterized in that an opening, in particular an elongated rectangle, is cut out of the ventilation duct, the device is fastened to a blank of duct material or transparent material protruding beyond the opening on all sides, introduced with the elastic air flap bent over, and the opening sealed again.

* * * * *